US005963116A

United States Patent [19]

Endoh et al.

[11] Patent Number: 5,963,116

[45] Date of Patent: Oct. 5, 1999

[54] REED RELAY AND A METHOD OF PRODUCING THE REED RELAY

[75] Inventors: Tomohisa Endoh; Yukishige Noguchi; Yukihiro Takano; Hideto Harayama, all of Iiyama, Japan

[73] Assignee: Fujitsu Takamisawa Component Limited, Tokyo, Japan

[21] Appl. No.: 09/227,090

[22] Filed: Jan. 5, 1999

[30] Foreign Application Priority Data

Jan. 8, 1998 [JP] Japan ..... 10-002566

[51] Int. Cl.[6] ..... H01H 51/28

[52] U.S. Cl. ..... 335/151; 335/154; 29/622

[58] Field of Search ..... 335/151–154, 335/205–208; 29/602.1, 622, 854, 855

[56] References Cited

U.S. PATENT DOCUMENTS

| | | | |
|---|---|---|---|
| 3,439,303 | 4/1969 | Purzycki | 335/151 |
| 3,575,678 | 4/1971 | Barton | 335/151 |
| 4,177,439 | 12/1979 | Smith | 335/151 |
| 4,812,794 | 3/1989 | Asbell et al. | 335/151 |
| 5,559,482 | 9/1996 | Close et al. | 335/151 |

FOREIGN PATENT DOCUMENTS 10-31950 2/1998 Japan .

*Primary Examiner*—Lincoln Donovan
*Assistant Examiner*—Raymond Barrera
*Attorney, Agent, or Firm*—Staas & Halsey

[57] ABSTRACT

A reed relay includes a reed switch with contacts, and a pair of terminals connected to the contacts. A tubular electrostatic shield defines an axially extending central bore within which the reed relay is inserted. A coil assembly has a winding drum, and a coil provided on the winding drum. The winding drum defines an axially extending central bore within which the electrostatic shield is inserted with the reed switch. A first pair of leads extend oppositely to each other, and are connected to the electrostatic shield at the opposite ends of the coil assembly. A second pair of leads extend oppositely to each other, and are connected to the electrostatic shield at the opposite ends of the coil assembly. A third pair of leads extend oppositely to each other, and are connected to the coil at the opposite ends of the coil assembly. A fourth pair of leads extend oppositely to each other, and are connected to the terminal of the reed switch at the opposite ends of the coil assembly. The fourth pair of leads being disposed between the first and second pairs of leads.

12 Claims, 15 Drawing Sheets

REED RELAY AND A METHOD OF PRODUCING THE REED RELAY

BACKGROUND OF THE INVENTION

1. Field of the Invention

The invention relates to a reed relay which includes a tubular electrostatic shield between a reed switch and a coil.

2. Description of the Related Art

Reed relays are used for various applications and, in particular, in an IC tester, since the contacts thereof are sealed so that the reed relay is less effected by the environment.

With reference to FIG. 19, a conventional reed relay will be described below. The reed relay includes a coil assembly 100, a tubular electrostatic shield 118 which defines an axially extending central bore, and a reed switch 120. The coil assembly 100 includes a coil 106 provided on a coil bobbin of a resin material. The coil bobbin includes a tubular winding drum 104 which defines an axially extending central bore 108, and opposite end flanges 102. The electrostatic shield 118 is inserted into the central bore 108 of the coil bobbin, and the reed switch 120 is inserted into the central bore of the tubular electrostatic shield 118. The reed switch 120 includes a glass body 120 sealingly enclosing the contacts (not shown) which are connected to terminals 122.

The coil assembly 100 further includes a first pair of leads 110 connected to terminals 118*a* of the electrostatic shield 118, a second pair of leads 112 connected to the coil 106, a third pair of leads 114 connected to the terminals 122 of the reed switch 120. The first, the second and the third pairs of leads are connected to the corresponding external terminals by welding and are integrally formed with the reed relay by an insert molding method.

In the conventional reed relay, the electrostatic shield 118 must be inserted into the central bore 108 of the coil bobbin. This increases the number of the parts and steps of the manufacture. Further, the terminals 118*a* of the electrostatic shield 118 are manually connected to the first pair in leads 110, which results in increase of the manufacturing cost.

The conventional reed relay is not adapted for installation on a circuit board which includes a very large number of reed relays such as a circuit board for an IC tester, nor is it designed in consideration of the electromagnetic effect, on the reed switch of a first lead relay, of the coil of a second adjacent reed relay through the leads connected to the coil of the second relay, and the leads connected to the reed switch of the first relay.

Further, the conventional reed relay is provided with a package which is formed by an insert molding method. According to a prior art, a plurality of reed relays are respectively disposed in a molding form for the insert molding method. This reduces the manufacturing efficiency.

SUMMARY OF THE INVENTION

The invention is directed to solve the above-mentioned problems and to provide an improved reed relay and a method of producing such a reed relay.

According to the invention, there is provided a reed relay, comprising: a reed switch with contacts, and a pair of terminals connected to the contacts, the reed switch defining an axis; a tubular electrostatic shield defining an axially extending central bore within which the reed relay is inserted with the terminals extending from the central bore; a coil assembly having a winding drum of a electrically insulating material, and a coil provided on the winding drum, the winding drum defining an axially extending central bore within which the electrostatic shield is inserted with the reed switch; a first pair of leads which extend oppositely to each other and parallel to the axis of the reed switch, and are connected to the electrostatic shield at the opposite ends of the coil assembly; a second pair of leads which extend oppositely to each other and parallel to the axis of the reed switch, and are connected to the electrostatic shield at the opposite ends of the coil assembly; a third pair of leads which extend oppositely to each other and parallel to the axis of the reed switch, and are connected to the coil at the opposite ends of the coil assembly; and a fourth pair of leads which extend oppositely to each other and parallel to the axis of the reed switch, and are connected to the terminal of the reed switch at the opposite ends of the coil assembly, the fourth pair of leads being disposed between the first and second pairs of leads.

According to another feature of the invention, there is provided a method of producing a reed relay, the reed relay including a reed switch with a contact, and a pair of terminals connected to the contact, the reed switch defining an axis, a tubular electrostatic shield defining an axially extending central bore for receiving the reed relay is inserted with the terminals extending from the central bore, a coil assembly having a winding drum of a electrically insulating material, and a coil provided on the winding drum, the winding drum defining an axially extending central bore within which the electrostatic shield is inserted with the reed switch. The method comprises the steps of: forming a first lead frame in the form of a strip including a plurality of first lead segments which includes a main portion for forming the tubular electrostatic shield, a first pair of leads which extend laterally and oppositely to each other and are connected to the main portion, a second pair of leads which extend laterally and oppositely to each other and are connected to the main portion, a third pair of leads which extend laterally and oppositely to each other and are not connected to the main portion, and a pair of tabs which are connected to the first, the second and the third pairs of leads at the outer ends thereof opposite to the main portion; forming the main portions into the tubular electrostatic shields by pressing; forming coil bobbins on the first lead frame by forming at least winding drums on the tubular electrostatic shields by an insert molding method with an electrically insulating material, the ends of the first, second and third leads adjacent to the main portion being embedded in the flanges; separating the coil bobbins from the first lead frame with tabs connected to the end of the first, the second and the third pairs of leads; providing a coil on the winding drum to provide a coil assembly; inserting the reed switch into the central bore of the electrostatic shield; and connecting a fourth pair of leads, which extend laterally and oppositely to each other, to the terminals of the reed switch.

DESCRIPTION OF THE DRAWINGS

These and other objects and advantages and further description will now be discussed in connection with the drawings in which.

DESCRIPTION OF THE PREFERRED EMBODIMENTS

Figure 1:
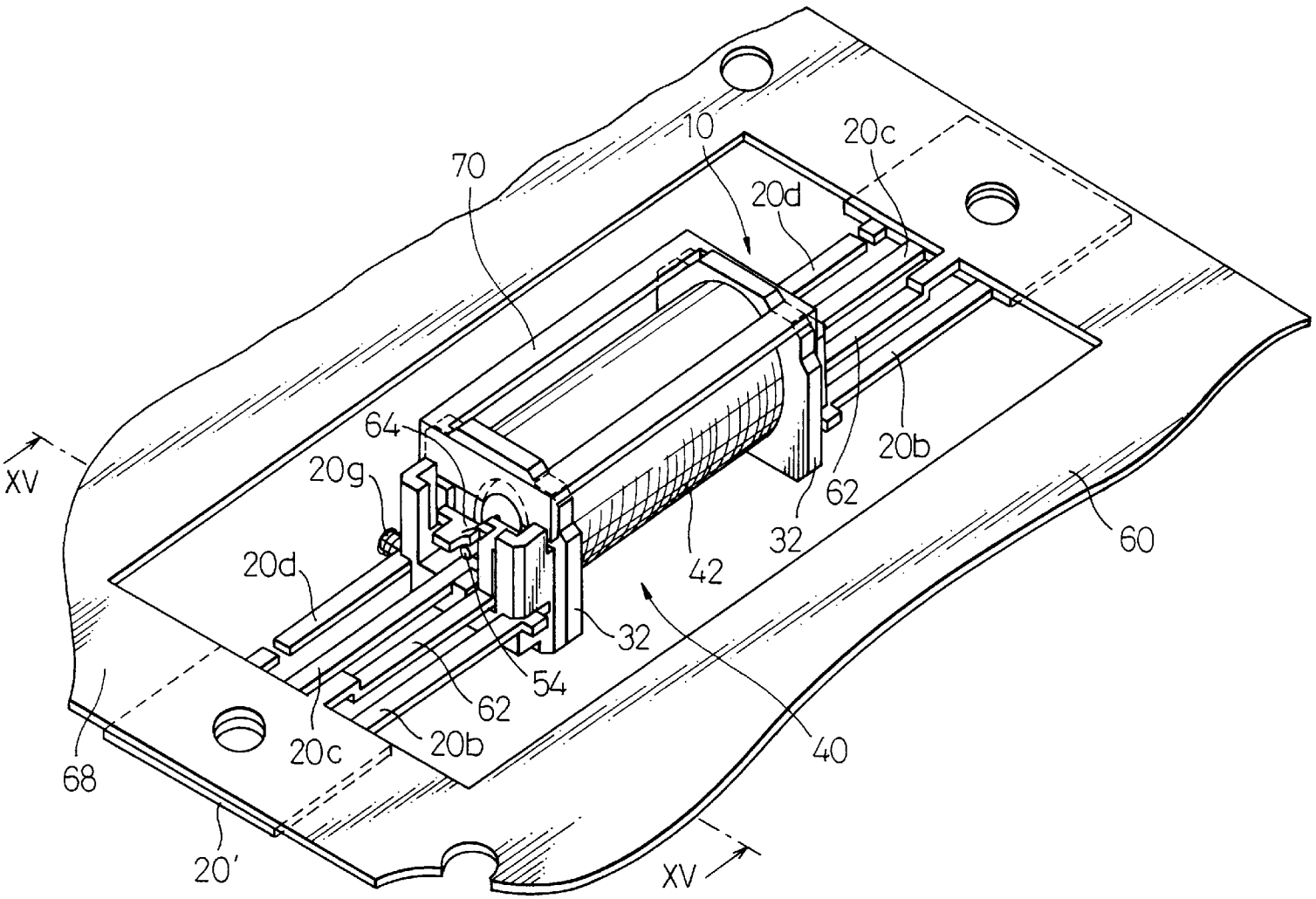
FIG. 1 is a perspective view of a reed relay according to the preferred embodiment, the reed relay being attached to a second lead frame.
Figure 5:
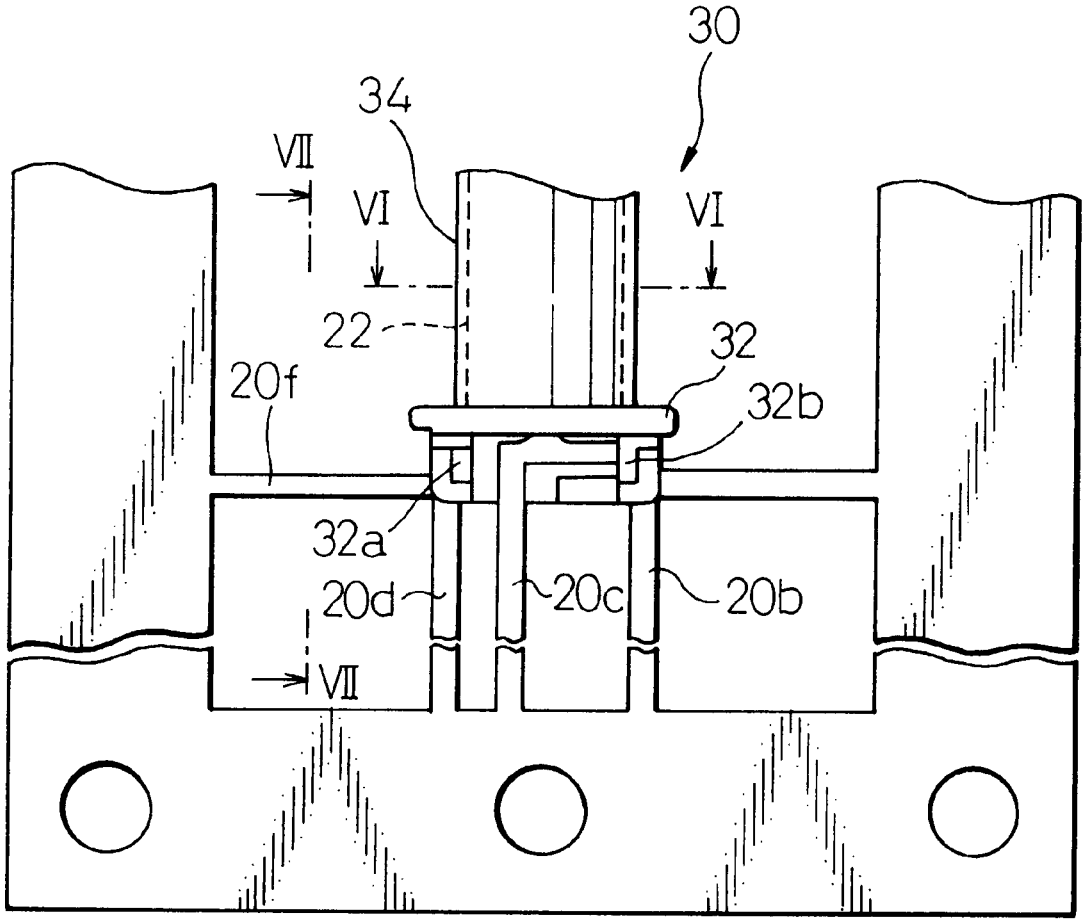
FIG. 5 is a partially enlarged plan view of the first lead frame in which a winding drum about the tubular electrostatic shield, and opposite end flanges are formed.

FIG. 1 shows a reed relay 10 according to an embodiment of the invention. The reed relay 10 includes a hollow coil assembly 40 (FIG. 8), a reed switch 50 (FIG. 9) inserted into a central bore 44 of the coil assembly 40. A plurality of the coil assemblies 40 can be made through the following steps:

forming a plurality of tubular electrostatic shields 22 from a first lead frame 20 (FIG. 2) in the form of a strip by pressing;

forming a winding drum 34 and end flanges 32 on the outer surface and the opposite ends, respectively, of each electrostatic shield 22 by an insert molding method with an electrically insulating material, preferably a liquid crystal polymer, to provide a coil bobbin 30 (FIGS. 5–7); and providing a coil 42 on the winding drum 34 after each coil bobbin 30 is separated from the first lead frame 20.

Figure 2:
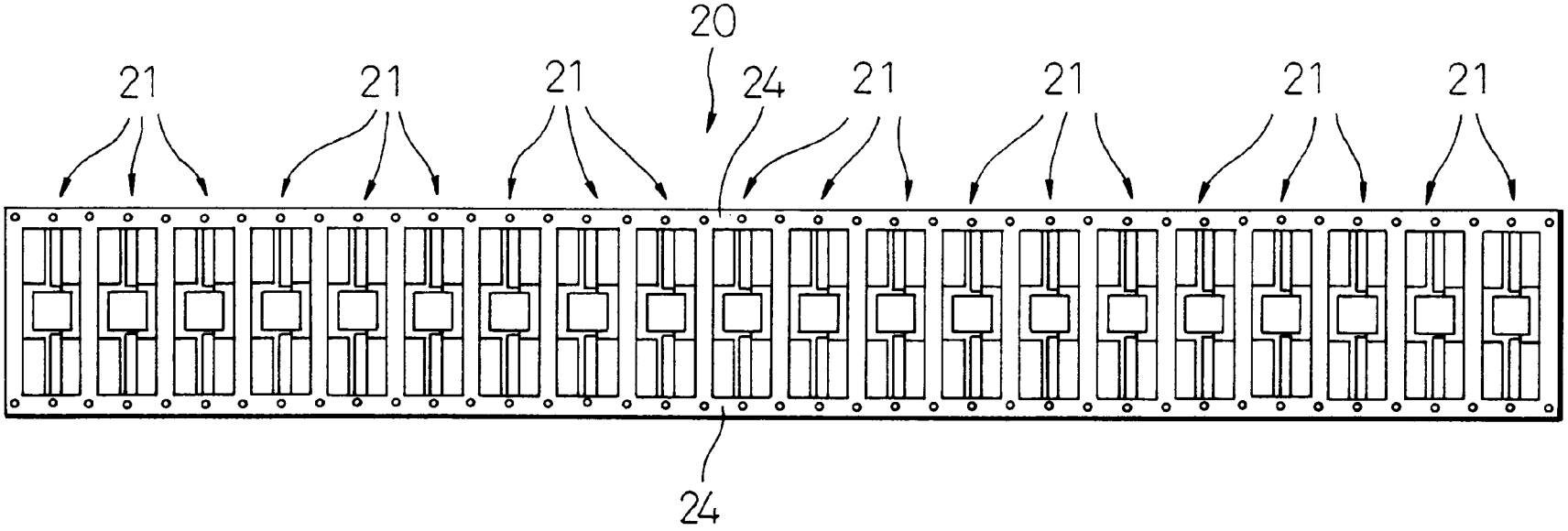
FIG. 2 is a plan view of a first lead frame.
Figure 3:
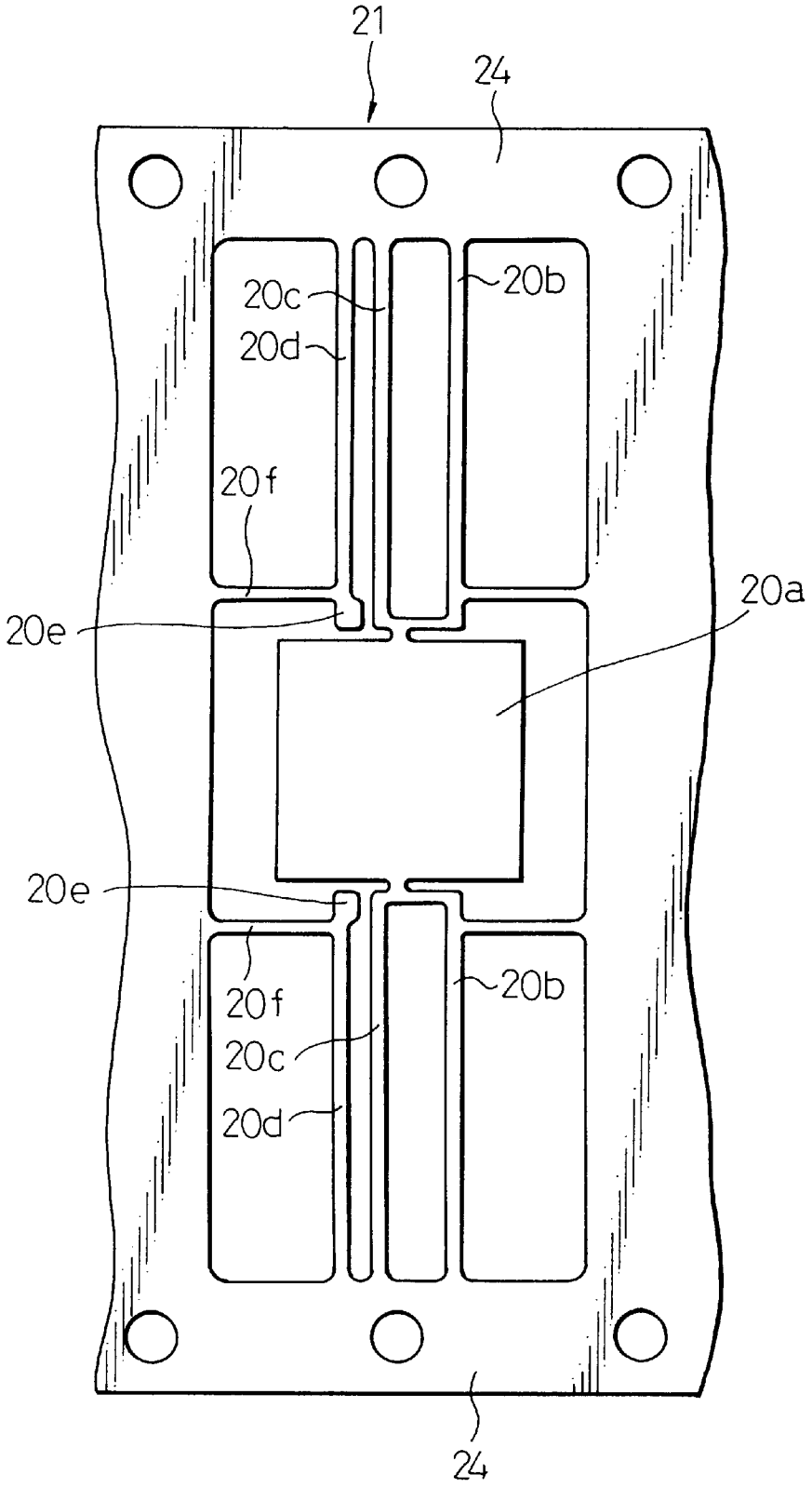
FIG. 3 is a partially enlarged plan view of the first lead frame of FIG. 2 showing a first lead frame segment.
Figure 4:
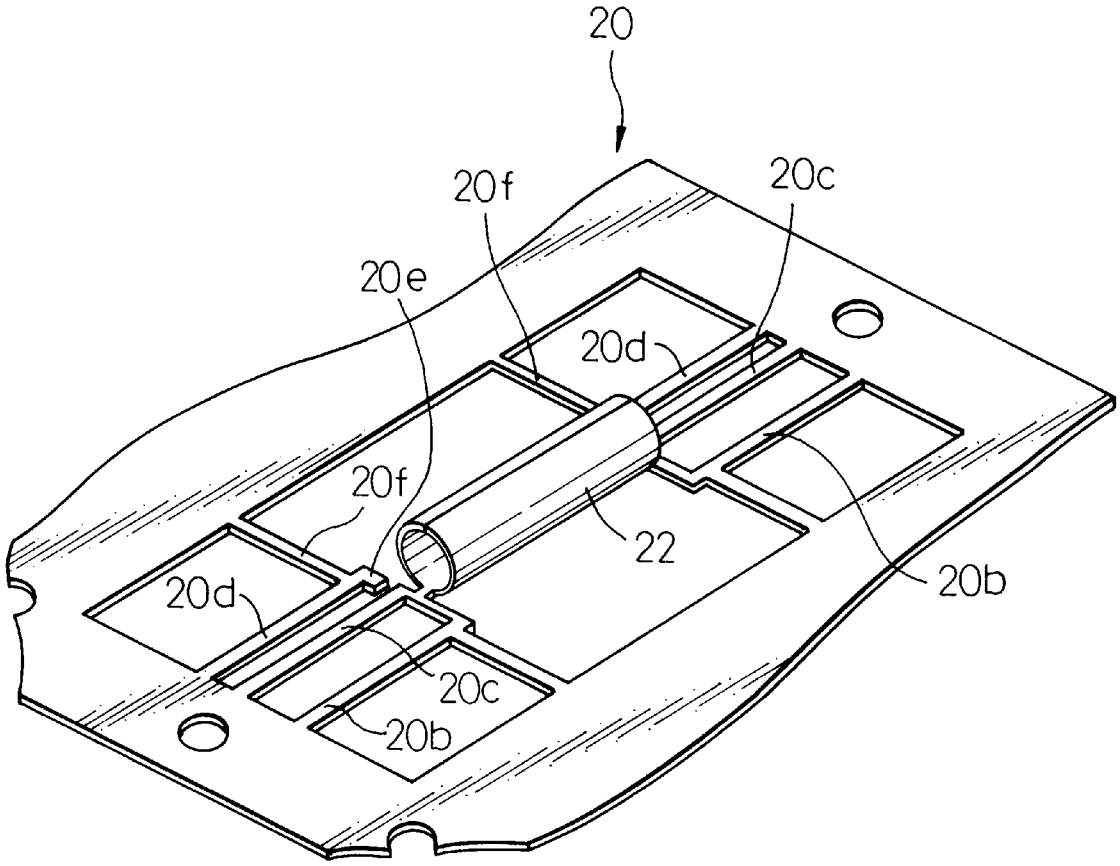
FIG. 4 is a perspective view of a tubular electrostatic shield formed on the first lead frame.

With reference to FIG. 2, the first lead frame 20 is a strip member of a non-magnetic material such as a copper alloy with a surface treatment such as solder plating. The first lead frame 20 includes a plurality of first lead frame segments 21. The first lead frame segment 21 includes a main portion 20*a*, which will be formed into the electrostatic shield 22 by pressing in a further step, first and second pairs of leads 20*b* and 20*c* which laterally extend between the main portion and longitudinal edge frames 24, a third pair of leads 20*d* which extend, parallel to the first and second pair of leads 20*b* and 20*c*, from the edge frames 24 toward the main portion 20*a*, and connecting portions 20*f* which longitudinally extend, and are connected to the inner ends of the respective third pair of leads 20*d*. Provided between the respective third pair of leads 20*d* and the connecting portions 20*d* are reinforcement tabs 20*e* for ensuring that the third pair of leads are secured to the opposite end flanges 32.

After the main portions 20*a* are formed into the tubular electrostatic shields 22 by pressing, then the winding drums 34 and flanges 32 are formed by an insert molding method with an electrically insulating polymer material so that a plurality of coil bobbins 30 are provided on the first lead frame 20. The flanges 32 are formed so that the inner ends, adjacent to the electrostatic shield 22, of the first, the second and the third pairs of leads 20*b*, 20*c* and 20*d* are embedded in and fixed to the flanges 32.

Figure 6:
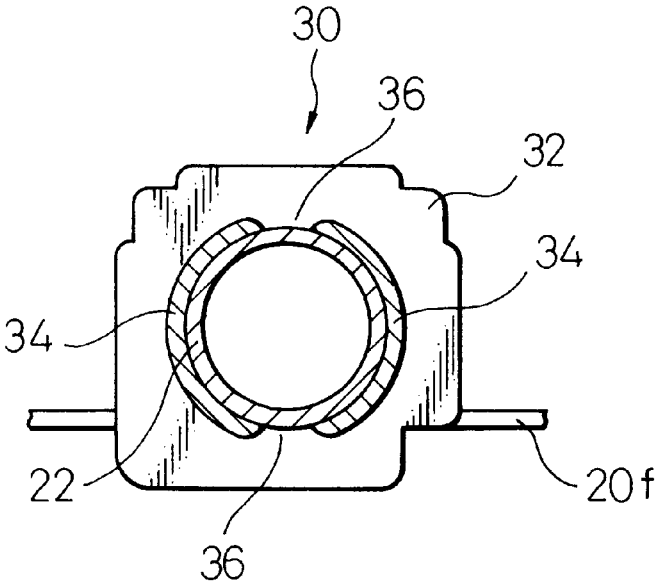
FIG. 6 is a section of the coil bobbin along line VI—VI in FIG. 5.
Figure 7:
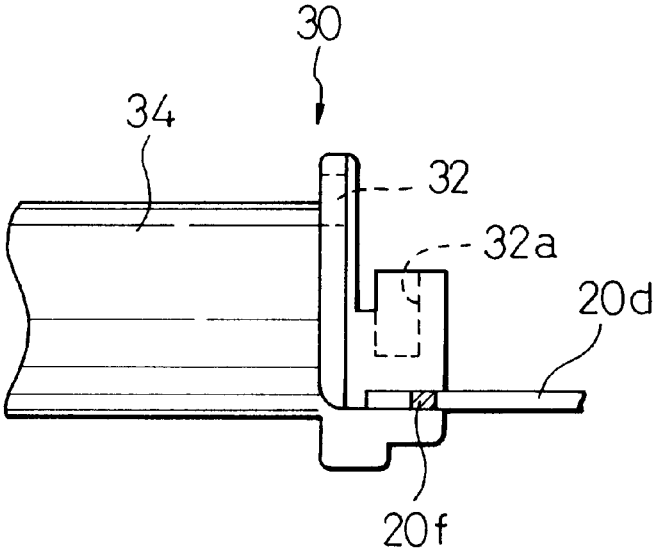
FIG. 7 is a side view of the coil bobbin viewed from line VII—VII in FIG. 5.

The winding drum 34 ensures the insulation between the coil 42 and the electrostatic shield 22 and protects the coil 42 from burrs which may be formed in the first lead frame 20. According to the embodiment, the winding drum includes a pair of drum halves 34. The pair of drum halves 34 are symmetrically provided relative to a vertical plane which extends through the longitudinal axis of the bobbin 30, as shown in FIG. 6, so that a pair of longitudinally extending slits 36 are provided diametrically opposite to each other between the drum halves 34. Providing the slits 36 on the winding drum 34 reduces the vertical size of the coil 42 when the coil 42 is provided on the winding drum 34 so that the overall size of the completed reed relay is reduced. The flanges 34 include receptacles 32*a* and 32*b* for positioning and attaching a fourth pair of leads 62, as described hereinafter.

After the plurality of coil bobbins 30 are completed on the first lead frame 20, each of the coil bobbins 30 is separated from the first lead frame 20 so that the coil bobbins 30 include tabs 20' which are separated from the longitudinally extending edge frames 24 of the first lead frame 20. The connecting portions 20*f* are cut so that portions of the connecting portions 20*f* remaine on the separated coil bobbin 30 to provide coil connections 20*g*.

Figure 8:
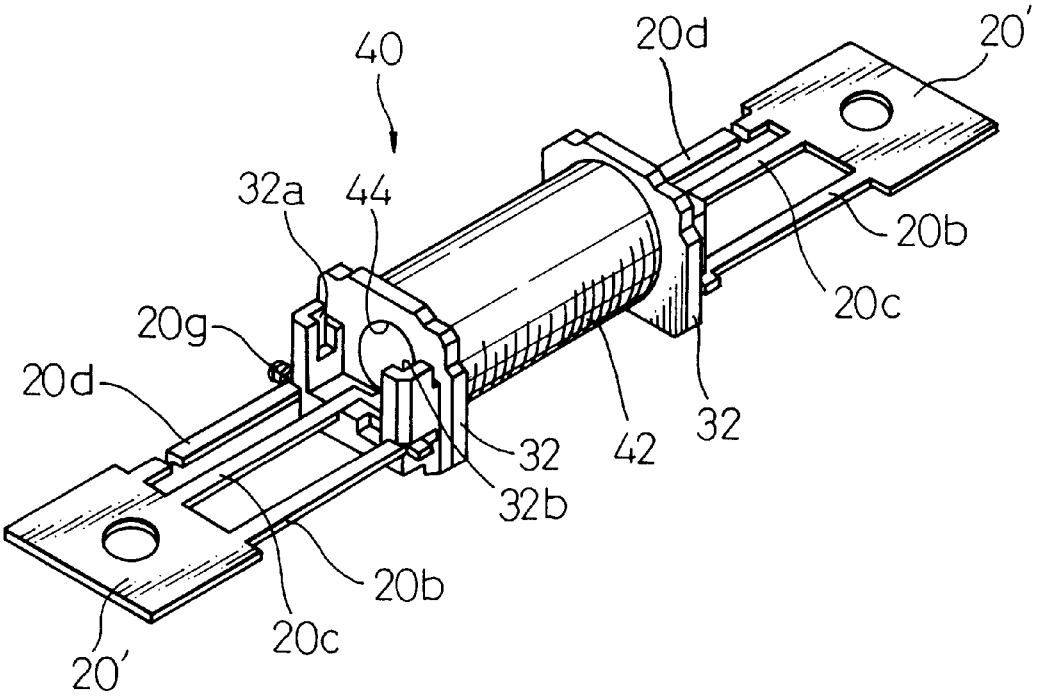
FIG. 8 is a perspective view of the coil assembly separated from the first lead frame.
Figure 9:
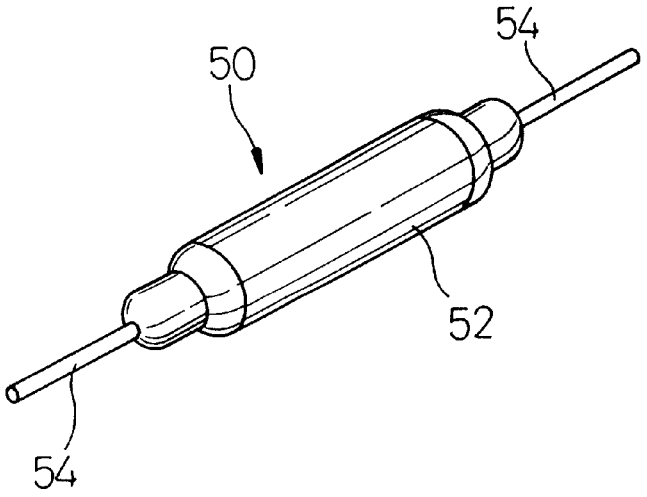
FIG. 9 is a perspective view of a reed switch adapted for use with the invention.
Figure 10:
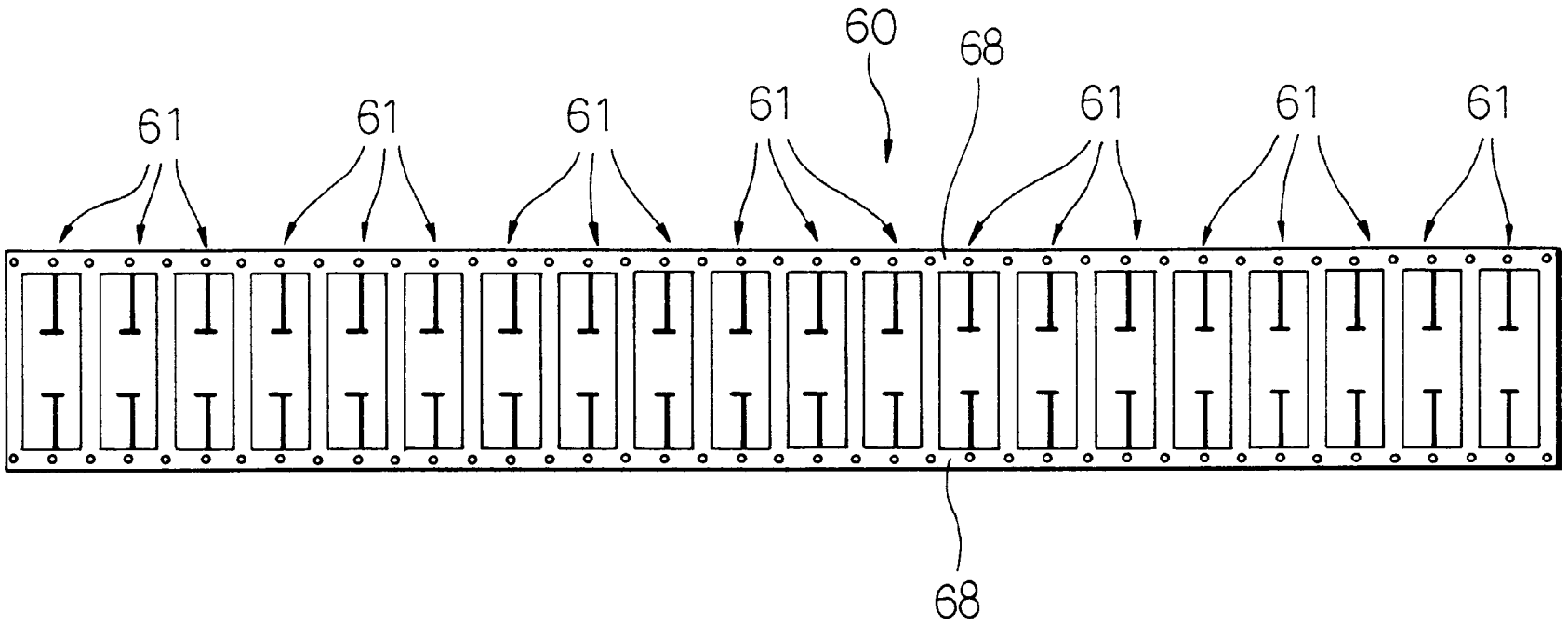
FIG. 10 is a plan view of a second lead frame.

Then, the coil 42 is provided by winding a wire on the winding drum 34 to provide a coil assembly 40 (FIG. 8). The ends of the coil 42 are connected to the coil connections 20*g*, respectively. The third pair of leads 20*d* are separated from the tabs 20' for testing the coil assembly 40. That is, a test is executed on the respective coil assemblies 40 to determine the coil characteristics.

The coil assembly includes a central bore 44, which is the central bore of the electrostatic shield 22. A reed switch 50 is inserted into the central bore 44 to provide the reed relay 10. The reed switch 50 includes contacts (not shown), made of a magnetic material, in a glass body 52. The contacts are connected to terminals 54 secured to the body 52. After the reed switch 50 is inserted in the central bore 44 of the coil assembly 40, energizing and deenergizing of the coil 42 opens and closes the contacts of the reed switch 50.

Figure 13:
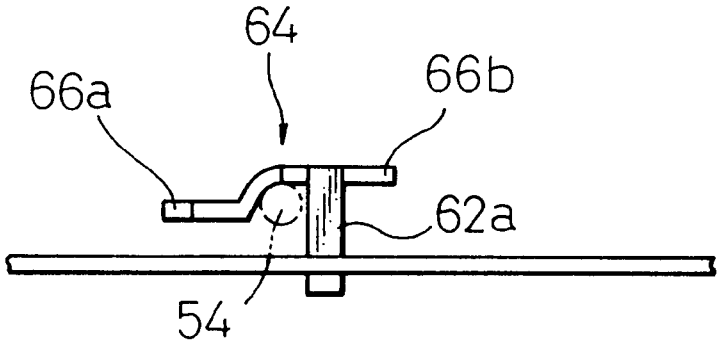
FIG. 13 is a front view of the second lead frame segment viewed along line XII—XII in FIG. 12.

Then, the reed relays 10 are connected to a second lead frame 60 (FIGS. 10–13). The second lead frame 60 is a strip member of a magnetic material such as a nickel steel alloy which may include nickel of, for example, 42–52%, with a surface treatment such as solder plating. The second lead frame 60 includes a pair of longitudinally extending edge frames 68 and a plurality of second lead frame segments 61. Each of the second lead frame segments 61 includes a fourth pair of leads 62 which extend laterally oppositely from the edge frames 68. The fourth leads 62 include connecting portions 64 which are adapted to be connected to the terminals 54 of the reed switch 50 incorporated with the reed relay 10, as shown in FIG. 13, and protrusions 66*a* and 66*b* on the either sides of the connecting portions 64. The protrusions are adapted to be fitted into the receptacles 32*a* and 32*b* of the flange 32 of the coil bobbin 30.

Figure 11:
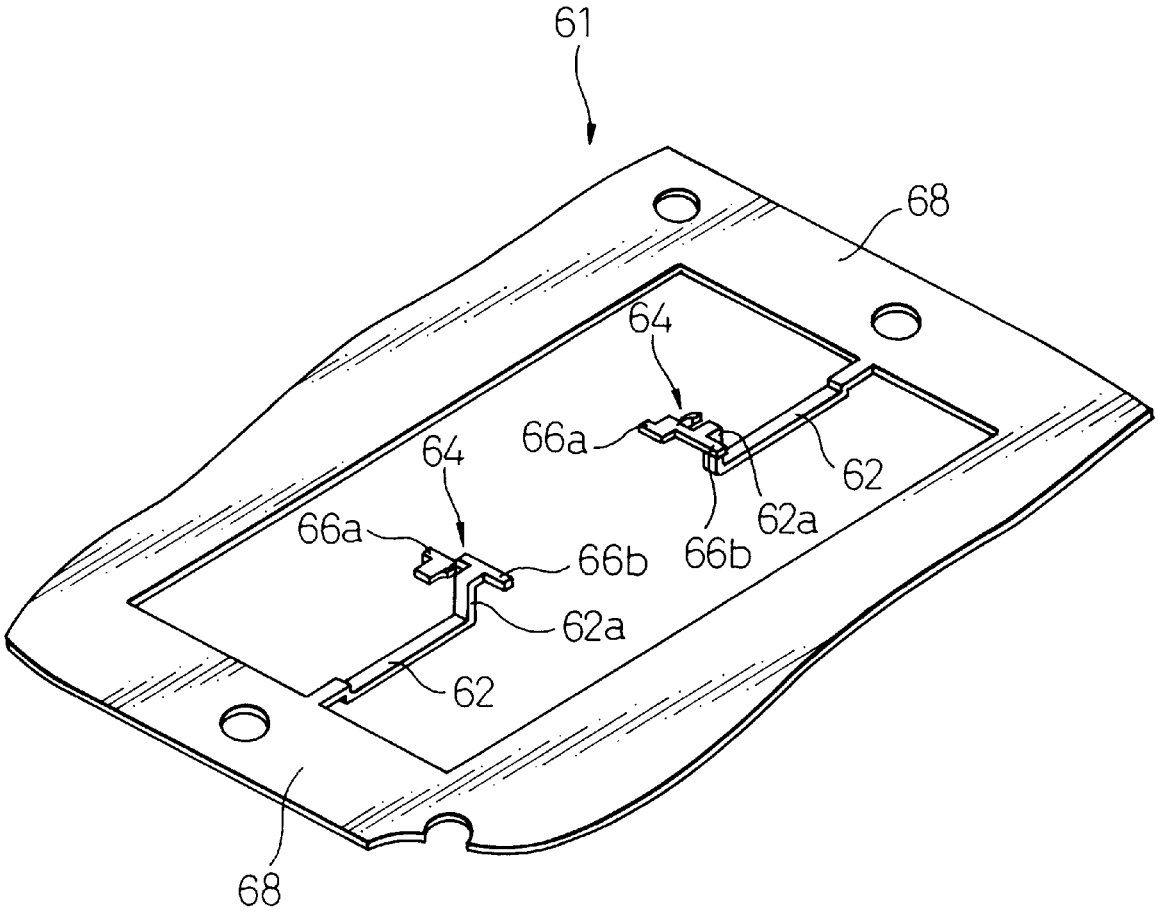
FIG. 11 is a partially enlarged perspective view of the second lead frame of FIG. 10 showing a second lead frame segment.
Figure 12:
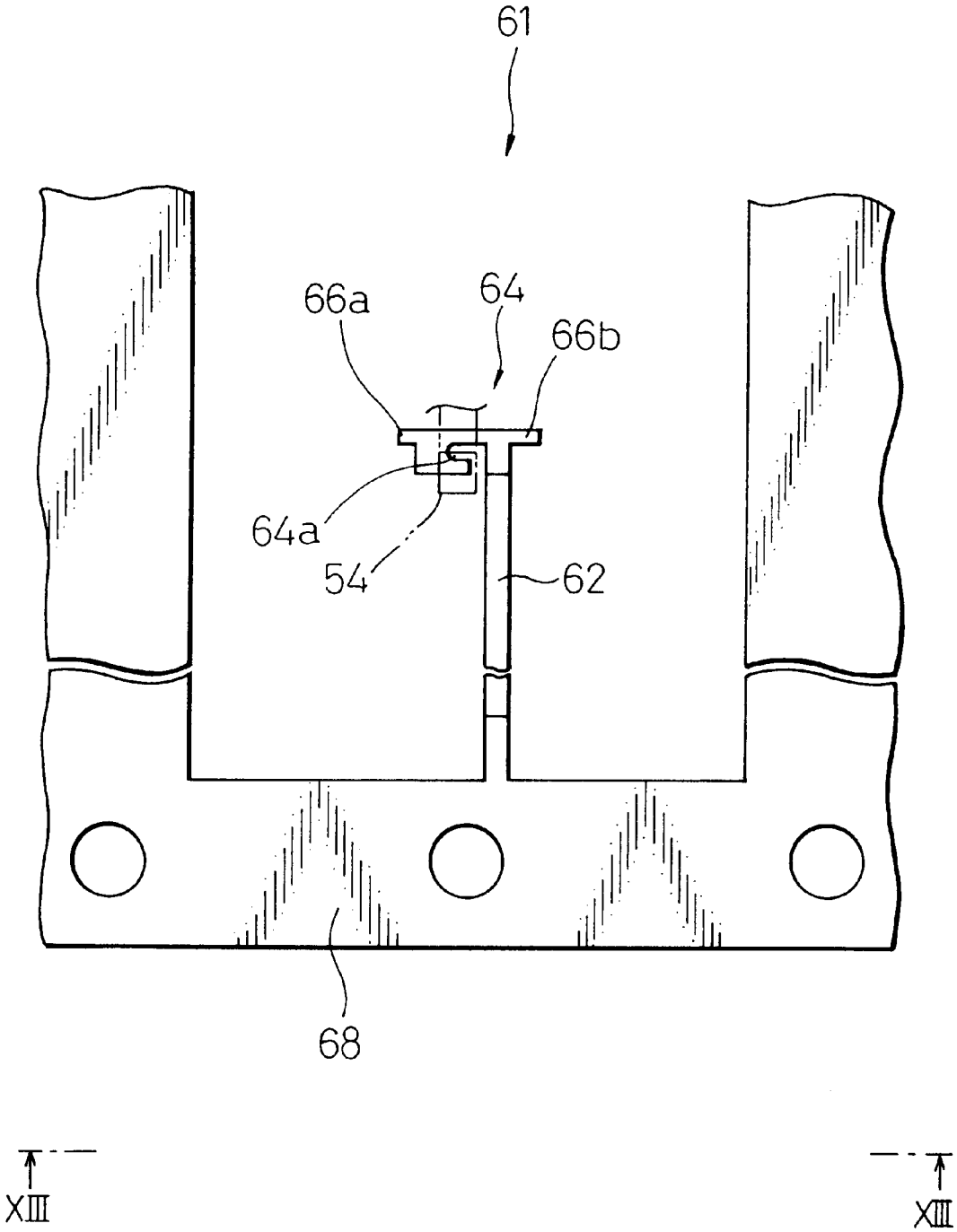
FIG. 12 is a partially enlarged plan view of the second lead frame segment of FIG. 11 showing one of the fourth pair of leads.

The second lead frame 60 is provided over the reed relays 10 which are disposed side by side in a number corresponding to the number of the second lead frame segments 61 included in the second lead frame 60. The second lead frame 60 is superposed on the reed relays 10 so that protrusions 66*a* and 66*b* are fitted into the receptacles 32*a* and 32*b* of the flange 32. The tabs 20' are connected to the edge frames 68 by welding to attach the reed relays 10 to the second lead frame 60. The fourth leads 62 are disposed between the first and second leads 20*b* and 20*c* of the respective reed relays 10. The fourth leads 62 include recessed portions which are disposed in a plane same as the first, second and third leads 20*b,* 20*c* and 20*d,* as shown in FIGS. 1 and 11, and upright extending portions 62*a,* provided between the ends of the recessed portions and the connecting portions 64, which allow the connecting portions 64 to engage the terminals 54 of the reed switches 50. The connecting portions 64 are connected to the terminals 54 by welding after the reed relays 10 are attached to the second lead frame 50. To facilitates the welding process, the connecting portions 64 include openings or cut-out portions 64*a*.

Figure 14:
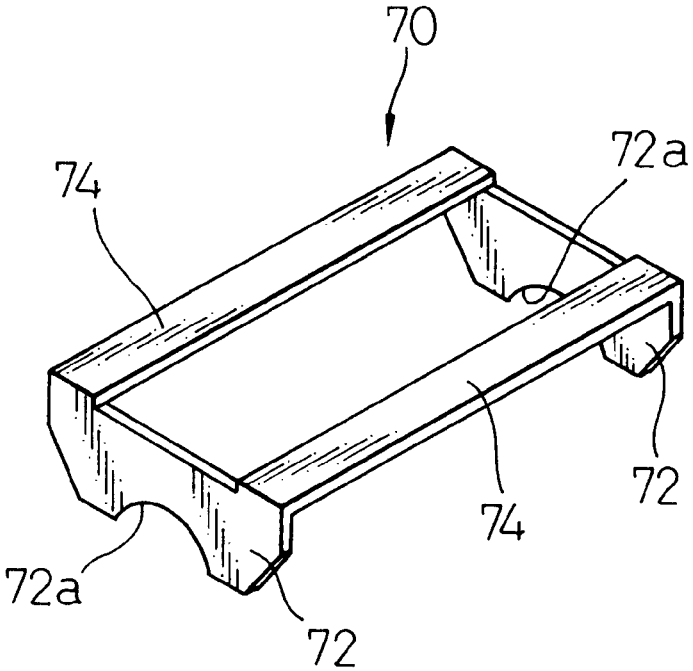
FIG. 14 is a perspective view of a yoke.
Figure 15:
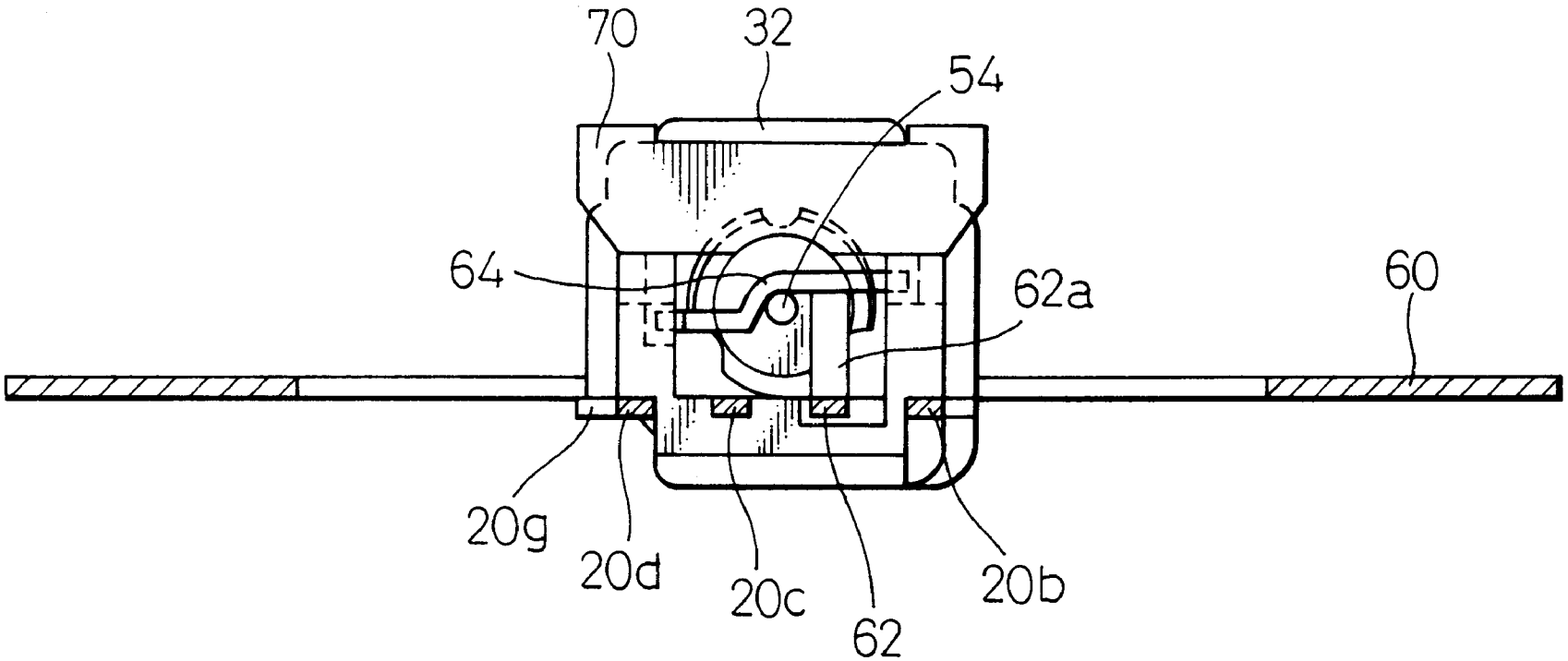
FIG. 15 is a front view of the reed relay viewed along line XV—XV in FIG. 1.
Figure 16:
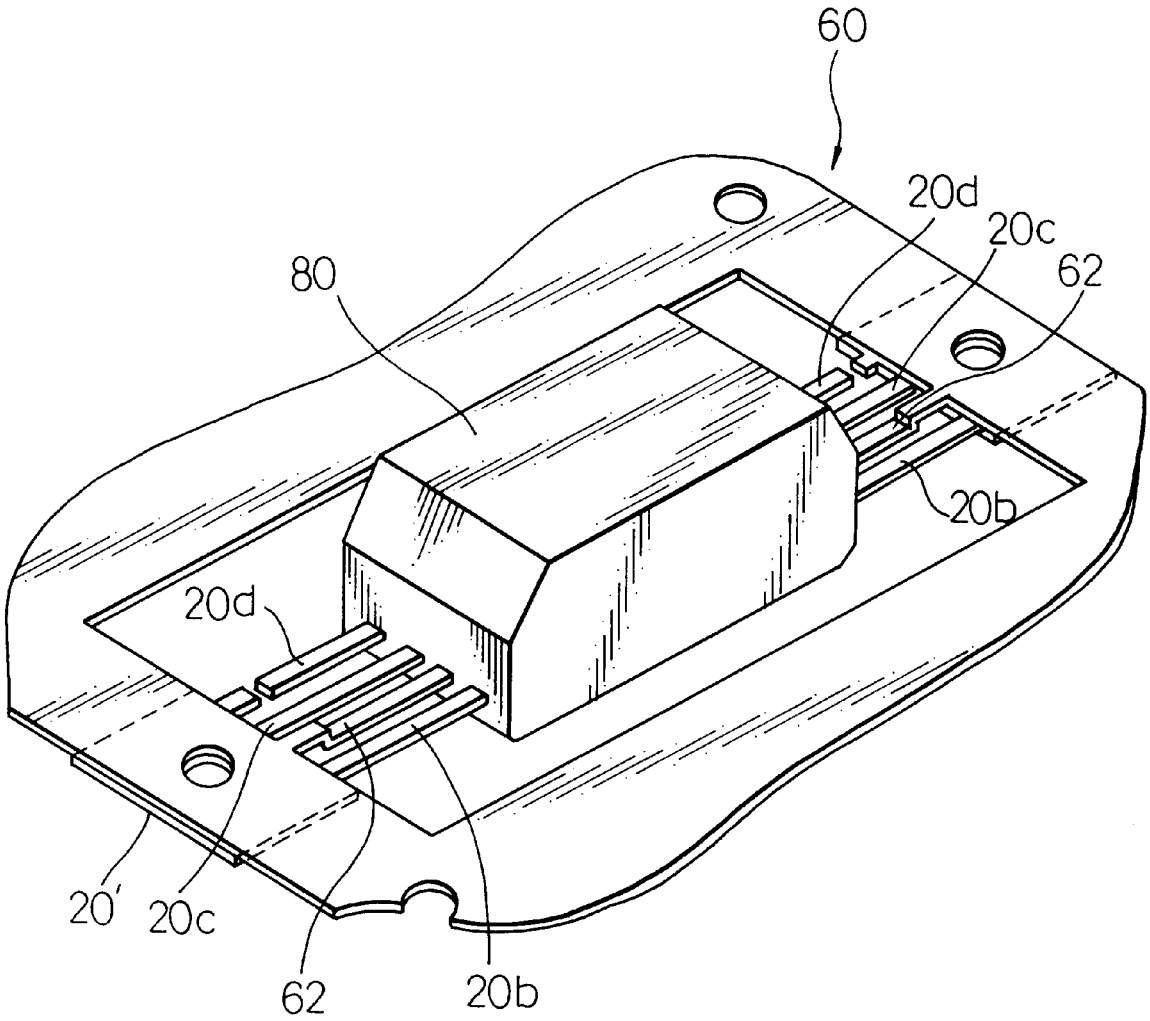
FIG. 16 is a perspective view of the reed relay shown in FIG. 1 with a package provided thereon by an insert molding method.

Each of the reed relays 10 is provided with yoke 70 (FIGS. 1, 14 and 15) for enhancing the magnetic field generated by the coil 42. The yoke 70 is made of magnetic material and includes a pair of end plates 72 and a pair of connecting portions 74 for connecting the end plates 72. The end plates 72 include cut-out portions 72*a* in the form of arcs. The cut-out portions 72*a* engage the end portions of the body 54 of the reed switch 52 to downwardly bias the reed switch 50 within the central bore 44.

Figure 17:
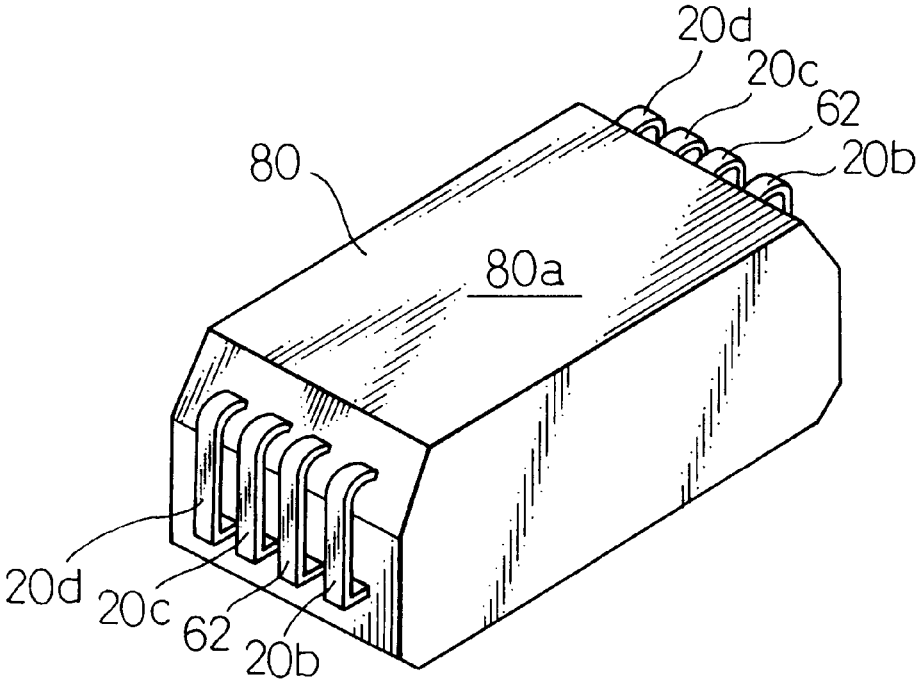
FIG. 17 is a perspective view of the reed relay which has been separated from the second lead fame with the first, second, third and fourth pairs of leads are bent into invert "J" shapes.
Figure 18:
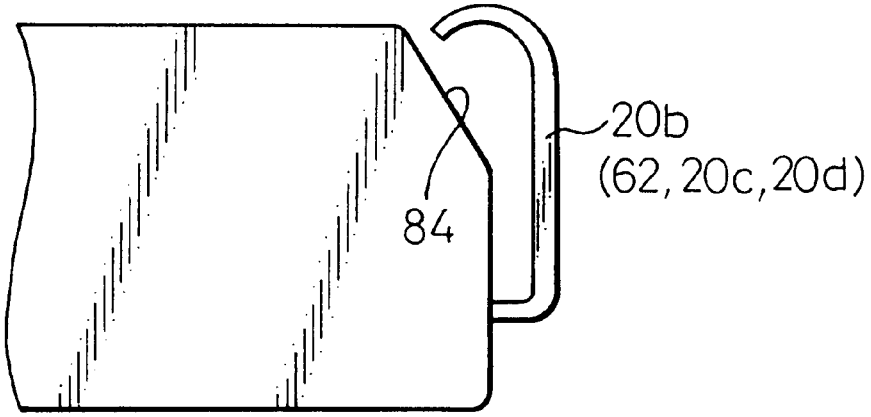
FIG. 18 is a partial side view of the reed relay of FIG. 17.
Figure 19:
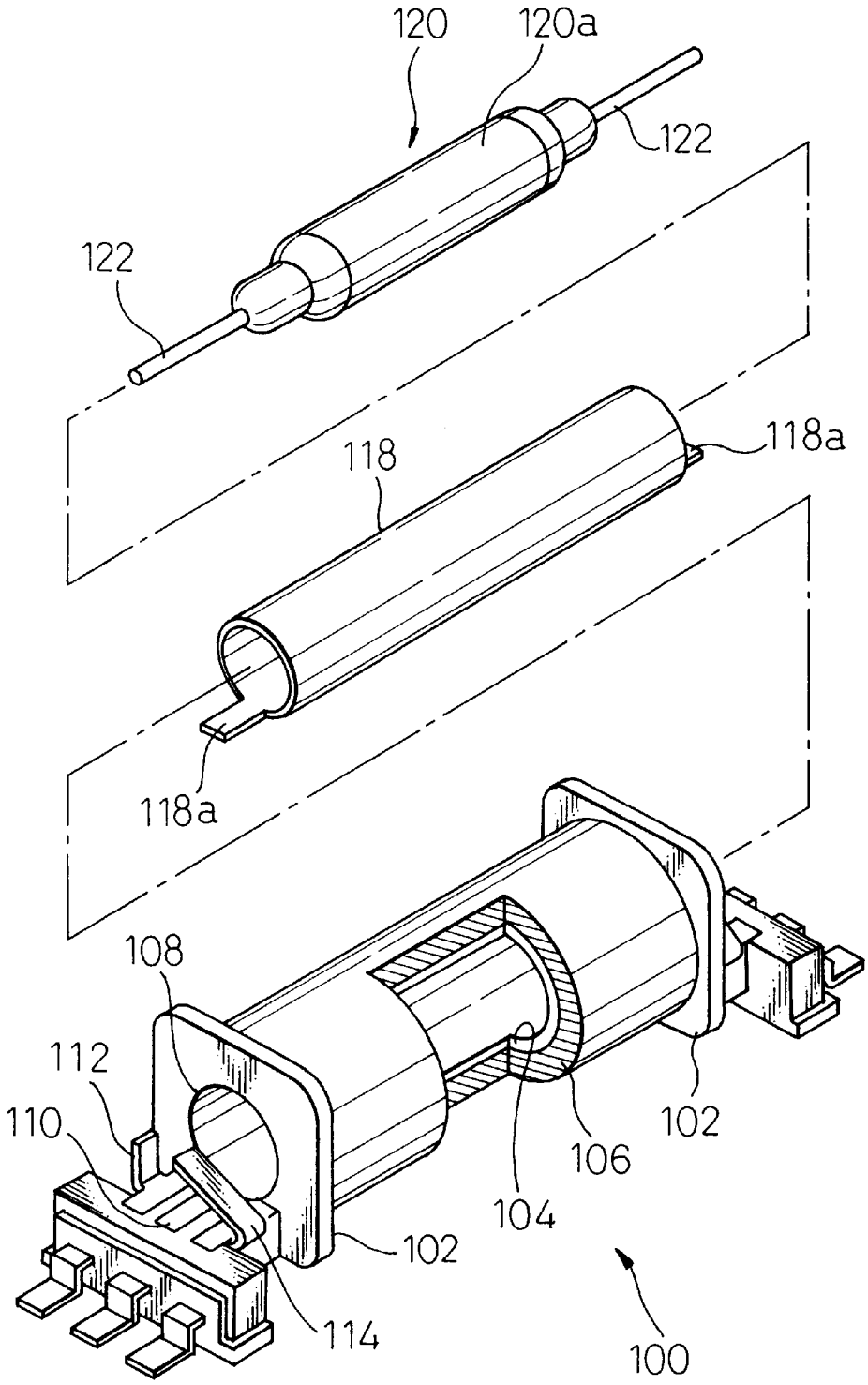
Fig.19 PRIOR ART
FIG. 19 is a perspective view of a conventional reed relay.

Packages 80 are provided on the respective reed relays 10, which are attached to the second lead frame 60 and provided with the yokes 70, by an insert molding method with an electrically insulating material. Then, the reed relays 10 are separated from the second lead frame 60 by cutting the first, second and fourth leads 20*b,* 20*c* and 62. Although the packages 80 can be made of epoxy resin, they are, preferably, made of a liquid crystal polymer. Finally, the first through fourth leads 20*b,* 20*c,* 20*d* and 62 are bent into substantially inverted "J" shapes at the sides of the package 80, as shown in FIGS. 17 and 18. The sides of the package 80 may include relieves 84 to facilitate the bending process.

In fact, the reed relay, thus produced, is attached to a circuit board (not shown) of a device, for example an IC tester, with a surface 80*a* facing the board. The fourth pair of leads 62, which are connected to the terminals 54 of the reed switch 50, are disposed between the first and second pair of leads 20*b* and 20*c* which are connected to the electrostatic shield 22. This reduces the effect of the coil 42 on the reed switch 50 through the fourth pair of leads 62. Disposing the leads connected to the terminal of the reed switch between two leads connected to the electrostatic shield is considerably advantageous when the reed relay is attached to a circuit board of an IC tester since an IC tester includes a great many reed relays.

It will also be understood by those skilled in the art that the forgoing description is a preferred embodiment of the disclosed device and that various changes and modifications may be made without departing from the spirit and scope of the invention.

We claim:

1. A reed relay, comprising:

a reed switch with contacts, and a pair of terminals connected to the contacts, the reed switch defining an axis;

a tubular electrostatic shield defining an axially extending central bore within which the reed relay is inserted with the terminals extending from the central bore;

a coil assembly having a winding drum of a electrically insulating material, and a coil provided on the winding drum, the winding drum defining an axially extending central bore within which the electrostatic shield is inserted with the reed switch;

a first pair of leads which extend oppositely to each other and parallel to the axis of the reed switch, and are connected to the electrostatic shield at the opposite ends of the coil assembly;

a second pair of leads which extend oppositely to each other and parallel to the axis of the reed switch, and are connected to the electrostatic shield at the opposite ends of the coil assembly;

a third pair of leads which extend oppositely to each other and parallel to the axis of the reed switch, and are connected to the coil at the opposite ends of the coil assembly; and a fourth pair of leads which extend oppositely to each other and parallel to the axis of the reed switch, and are connected to the terminal of the reed switch at the opposite ends of the coil assembly, the fourth pair of leads being disposed between the first and second pairs of leads.

2. A reed switch according to claim 1, wherein the winding drum includes an axial slit.

3. A reed switch according to claim 1, wherein the electrostatic shield, and the first, the second and the third pairs of leads are made of a non-magnetic material.

4. A reed switch according to claim 1, wherein the third pair of leads are made of a magnetic material.

5. A reed switch according to claim 1, wherein the first, the second, the third and the fourth pairs of leads are disposed in a common plane parallel to the axis of the reed switch.

6. A reed switch according to claim 1, wherein the coil bobbin is made of a liquid crystal polymer.

7. A method of producing a reed relay, the reed relay including a reed switch with a contact, and a pair of terminals connected to the contact, the reed switch defining an axis, a tubular electrostatic shield defining an axially extending central bore for receiving the reed relay is inserted with the terminals extending from the central bore, a coil assembly having a winding drum of a electrically insulating material, and a coil provided on the winding drum, the winding drum defining an axially extending central bore within which the electrostatic shield is inserted with the reed switch;

the method comprising the steps of:

forming a first lead frame in the form of a strip including a plurality of first lead segments which includes a main portion for forming the tubular electrostatic shield, a first pair of leads which extend laterally and oppositely to each other and are connected to the main portion, a second pair of leads which extend laterally and oppositely to each other and are connected to the main portion, a third pair of leads which extend laterally and oppositely to each other and are not connected to the main portion, and a pair of tabs which are connected to the first, the second and the third pairs of leads at the outer ends thereof opposite to the main portion;

forming the main portions into the tubular electrostatic shields by pressing;

forming coil bobbins on the first lead frame by forming at least winding drums on the tubular electrostatic shields by an insert molding method with an electrically insulating material, the ends of the first, the second and the third leads adjacent to the main portion being embedded in flanges of the bobbin;

separating the coil bobbins from the first lead frame with the tabs connected to the end of the first, the second and the third pairs of leads;

providing a coil on the winding drum to provide a coil assembly;

inserting the reed switch into the central bore of the electrostatic shield; and connecting a fourth pair of leads which extend laterally and oppositely to each other to the terminals of the reed switch.

8. A method of producing a reed relay according to claim 7, wherein the fourth pair of leads are disposed between the first and second pairs of leads.

9. A method of producing a reed relay according to claim 8, further comprising, before the step of connecting the fourth pair of leads, the steps of:

forming a second lead frame in the form of a strip which includes a plurality of second lead frame segments which includes the fourth pair of leads, and attaching the coil assemblies to the second lead frame.

10. A method of producing a reed relay according to claim 9, further comprising the steps of:

cutting the third pairs of leads from the tabs after the coil bobbins are separated from the first lead frame to provide a reed relay; and executing a test for determine the coil characteristics after providing the coil on the winding drum.

11. A method of producing a reed relay according to claim 10, further comprising the step of providing a yoke on the reed relay.

12. A method of producing a reed relay according to claim 11, further comprising the steps of providing a package on the reed relay by an insert molding method with an electrically insulating material.

* * * * *